US006896439B2

(12) United States Patent
Gasparotto

(10) Patent No.: US 6,896,439 B2
(45) Date of Patent: May 24, 2005

(54) SET OF METAL BODIES WITH RECTILINEAR AXIS AND CONSTANT CROSS SECTION FOR MAKING A CROSS FOR FIXING VERTICAL PLATES IN POINT-SUPPORTED SUSPENDED FACADES, AND CROSS THUS OBTAINED

(76) Inventor: Carmen Gasparotto, Duino, 72/L, I-34013 Duino Aurisina (IT)

( * ) Notice: Subject to any disclaimer, the term of this patent is extended or adjusted under 35 U.S.C. 154(b) by 0 days.

(21) Appl. No.: 10/239,565

(22) PCT Filed: Mar. 27, 2001

(86) PCT No.: PCT/IB01/00496

§ 371 (c)(1),
(2), (4) Date: Sep. 24, 2002

(87) PCT Pub. No.: WO01/73251

PCT Pub. Date: Oct. 4, 2001

(65) Prior Publication Data

US 2003/0059252 A1 Mar. 27, 2003

(30) Foreign Application Priority Data

Mar. 27, 2000 (IT) ..... MI2000A0641

(51) Int. Cl.[7] ..... E04B 2/88

(52) U.S. Cl. ..... 403/293; 52/235; 403/408.1

(58) Field of Search ..... 403/169–172, 403/217, 218, 292–294, 304, 408.1; 52/235, 506.05

(56) References Cited

U.S. PATENT DOCUMENTS

| | | | | | |
|---|---|---|---|---|---|
| 2,684,003 | A | * | 7/1954 | Klingler | 29/751 |
| 4,930,930 | A | * | 6/1990 | Coppa | 403/171 |
| 5,624,200 | A | * | 4/1997 | Beaulieu | 403/217 |

FOREIGN PATENT DOCUMENTS

| | | | | | |
|---|---|---|---|---|---|
| DE | 29706757 | U1 | * | 6/1997 | E04B/1/61 |
| EP | 271980 | A1 | * | 6/1988 | G09F/15/00 |
| EP | 595317 | A1 | * | 5/1994 | E04B/2/88 |
| FR | 2 716 503 | A | | 8/1995 | |
| GB | 2 242 248 | A | | 9/1991 | |
| GB | 2242248 | A | * | 9/1991 | F16B/35/06 |
| GB | 2263147 | A | * | 7/1993 | F16B/12/36 |

* cited by examiner

*Primary Examiner*—James R. Brittain
(74) *Attorney, Agent, or Firm*—Lorusso & Loud

(57) ABSTRACT

A set of metal bodies each having a rectilinear axis and constant thickness can be appropriately connected together to form a cross with one, two, three, or four arms, for use in fixing vertical plates in point-supported continuous facades.

38 Claims, 8 Drawing Sheets

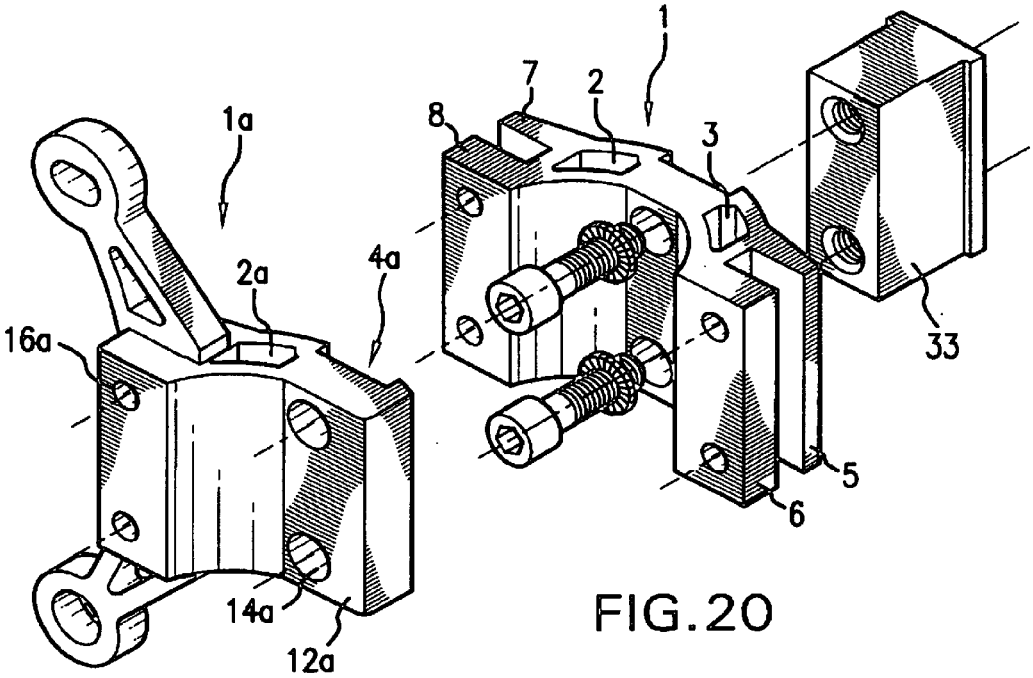
FIG.19
FIG.20
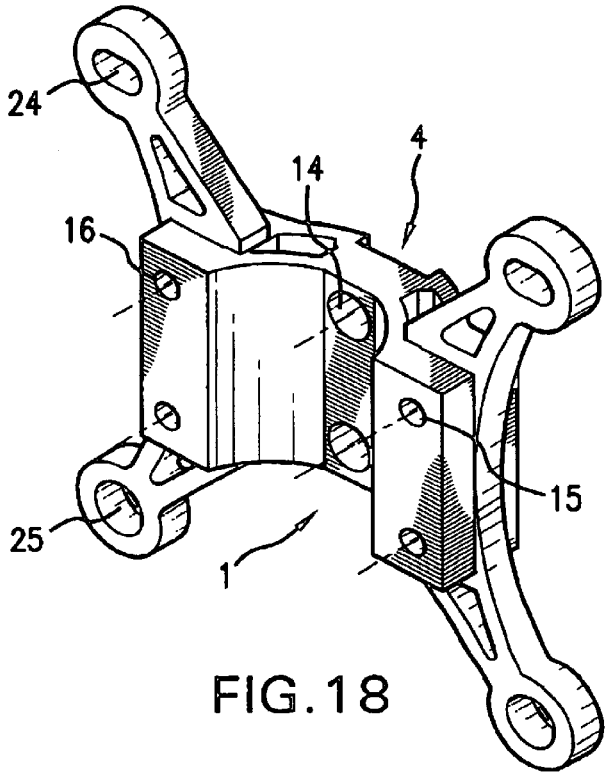
FIG.18

SET OF METAL BODIES WITH RECTILINEAR AXIS AND CONSTANT CROSS SECTION FOR MAKING A CROSS FOR FIXING VERTICAL PLATES IN POINT-SUPPORTED SUSPENDED FACADES, AND CROSS THUS OBTAINED

BACKGROUND OF THE INVENTION

1. Field of the Invention

The present invention is a set of metal bodies with rectilinear axis and constant cross-section for making a member for the fixing and support of contiguous vertical plates in point-supported suspended facades. The present invention further relates to a member for the fixing and support of vertical plates in point-supported suspended facades obtained by putting together the metal bodies with rectilinear axis and constant cross-section.

2. The Prior Art

For making point-supported suspended facades it is known to use so-called crosses, i.e., members for fixing and supporting vertical plates, comprising a central hole for fixing the cross to a supporting structure (typically an upright) and, according to the number of vertical plates to be supported, from one to four arms provided at their ends with circular holes or slots for insertion of fixed or articulated joints, to which the corners of the plates to be supported are fixed.

According to the prior art, the crosses are made of light-alloy castings or by the stamping of steel.

In view of the need to have crosses with a variable number of arms and the need to provide both circular holes and slots for insertion of the fasteners, it follows that it would be necessary to have in store a relatively large number of different types of crosses. This would call for a large number of dies and would therefore involve high production costs. In order to reduce the costs, it is preferred to produce only crosses with two or four arms and to cut off the excess arms as required.

In addition, it is preferred to make only slotted openings in the arms, which can be subsequently enlarged if required to convert them into circular openings.

However, all such subsequent processes have a marked affect on the total processing times, and hence on the final cost of the crosses, as well as on the general appearance of the crosses.

SUMMARY OF THE INVENTION

The purpose of the present invention is therefore to provide a new system for making crosses for fixing and supporting plates, which is technically simple and which enables a reduction in production costs. The above purpose is achieved by providing a set of metal bodies having a rectilinear axis and constant cross-section.

Accordingly, the present invention provides a "cross" for connecting plates in a planar array. The cross includes a "connector" as a main body portion which, in turn, includes an arched portion and at least one pair of flanges extending from the arch portion and defining therebetween a substantially rectangular groove. The groove of the flanges mates with a groove formed across a convex edge of a "connecting element" which may have a generally crescent shape or approximately half of a generally crescent shape.

BRIEF DESCRIPTION OF THE DRAWINGS

FIG. 18 is a perspective view of a first embodiment of the cross;

FIG. 19 is a perspective view of a second embodiment of a cross; and

FIG. 20 shows the fixing of the cross to a supporting upright.

DESCRIPTION OF THE PREFERRED EMBODIMENTS

Figure 12:
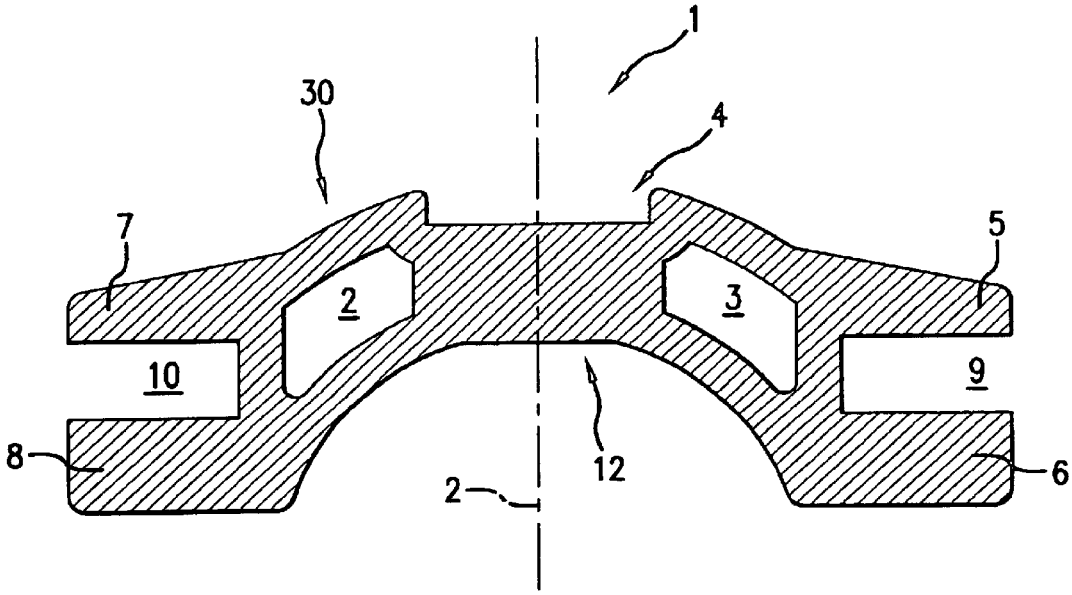
FIG. 12 is a cross-sectional view of a first embodiment of an extruded "connector"

FIGS. 12, 18 and 20 illustrate a first embodiment of a cross for fixing vertical plates in accordance with the invention comprises a central body, or cross support, 1, on which at least one arm 20 or 20*a* (FIGS. 14 and 15) is mounted, designed to support a fixed or articulated joint.

The central body ("connector") 1 is a metal body of an appropriate length with a rectilinear axis and constant cross-section and presents a symmetrical profile with respect to an axis of symmetry 2 and has a generally omega shape (FIG. 12).

Preferably, the central body 1 is made by extrusion. Of course, a person skilled in the art will be able to conceive other processes for making the central body 1, in particular stamping or pressure casting.

According to the first embodiment, the central body 1 has a planar surface 12 in the concave bottom of an arched portion 30, an axial groove 4 in the convex top of the arched portion 30, the arched portion 30 having one or more through holes 14 aligned on the axis of symmetry 2 (see FIG. 18). Two flanges set on top of one another 5, 6 and 7, 8, are integral with and project from the arched portion 30. The flanges define two substantially rectangular grooves 9 and 10. The combination of arched portion 30 and flanges 5, 6 and 7, 8 has an omega shape. One or more pairs of through holes 15, 16 are formed in flanges 5, 6, 7 and 8.

Preferably, the through holes 14 have a portion of larger diameter in an area corresponding to the concave side of the arched portion 30 so as to receive the head of a screw.

In the embodiment illustrated, the central body 1 has closed cavities 2, 3 symmetrically located in the arched portion 30. Likewise, one of the two through holes 15 or 16 preferably has a widened part designed to receive, at least partially, the head of a screw, while the other of the two through holes of each pair is threaded.

In the preferred embodiment, the axial groove 4 is connected to a special foot or base 33, which is in turn designed to be inserted into an undercut groove of an appropriate supporting upright (not shown).

Figure 13:
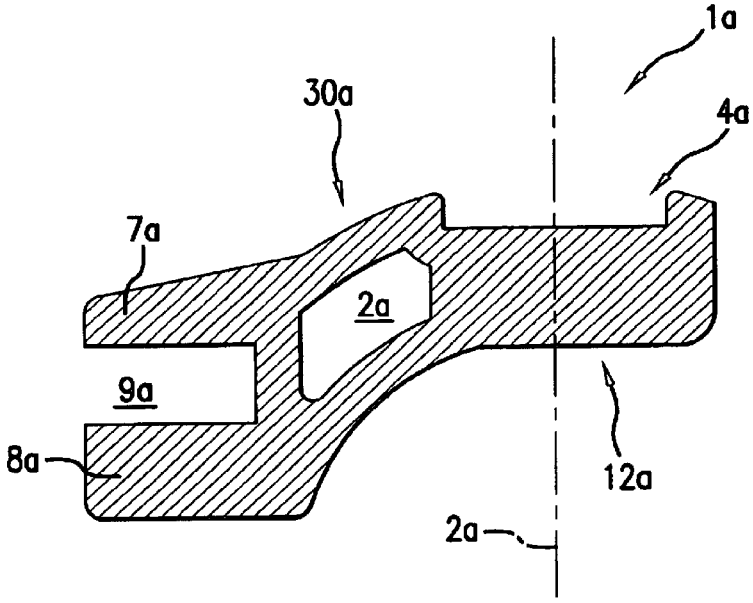
FIG. 13 is a cross-sectional view of a second embodiment of an extruded "connector"

A second embodiment illustrated in FIGS. 13 and 19, has a central body ("connector") designated by the reference number 1*a* (FIG. 13), wherein the omega section is modified in that one of the two pairs of projecting flanges 5, 6 or 7, 8 and part of the corresponding arched portion are missing.

The central body 1*a* will be used in the case where the cross is to support just one vertical plate, or else two plates set on top of one another.

Figure 14:
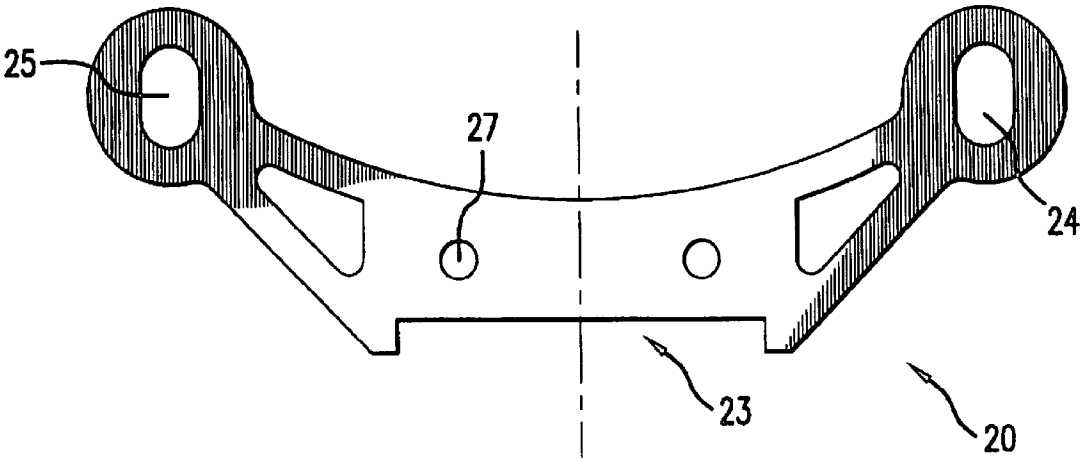
FIG. 14 is a plan view of a first embodiment of an extruded arm section.
Figure 15:
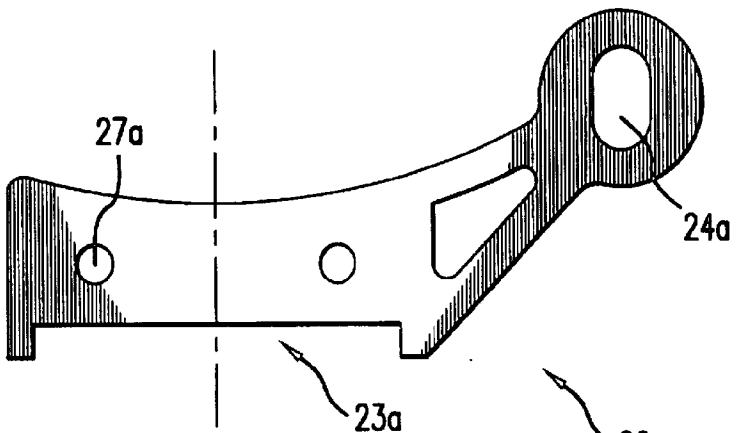
FIG. 15 is a plan view of a second embodiment of an extruded arm section.
Figure 16:
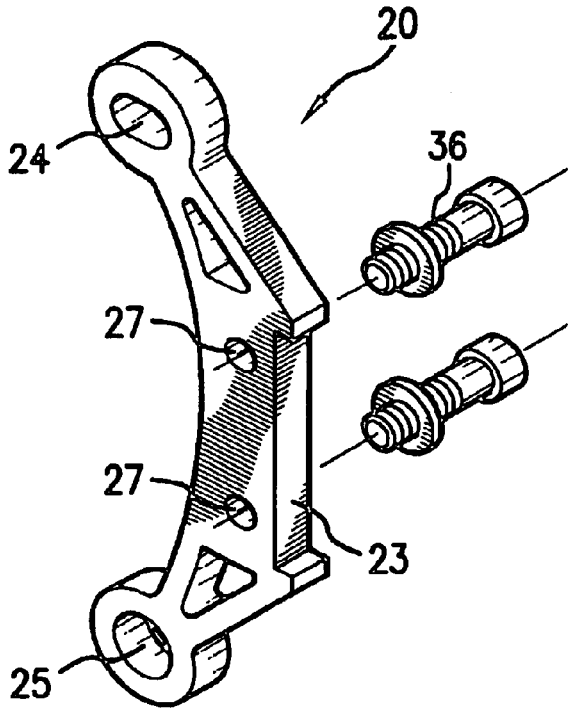
FIG. 16 is a perspective view of the extruded arm section illustrated in FIG. 14.

In the first embodiment, as shown in FIGS. 14, 16 and 18, arm or arms 20 ("connecting element") connected to the central body 1, are made up of metal bodies with a rectilinear axis and a constant cross-section with a profile that is symmetrical with respect to an axis of symmetry 21. According to the preferred embodiment, the arms ("connecting elements") 20 are extruded; however, a person skilled in the art will be able to conceive other processes such as stamping or pressure casting.

According to the first embodiment, the arm 20 is generally crescent-shaped, cut to an appropriate length, one or more through holes 27 parallel to the rectilinear axis, and two eyelets 24, 25 one, at either end of the crescent.

Preferably a groove 23 is provided in the convex top so as to enable slot-in connection with the omega-shaped central body 1.

Figure 11:
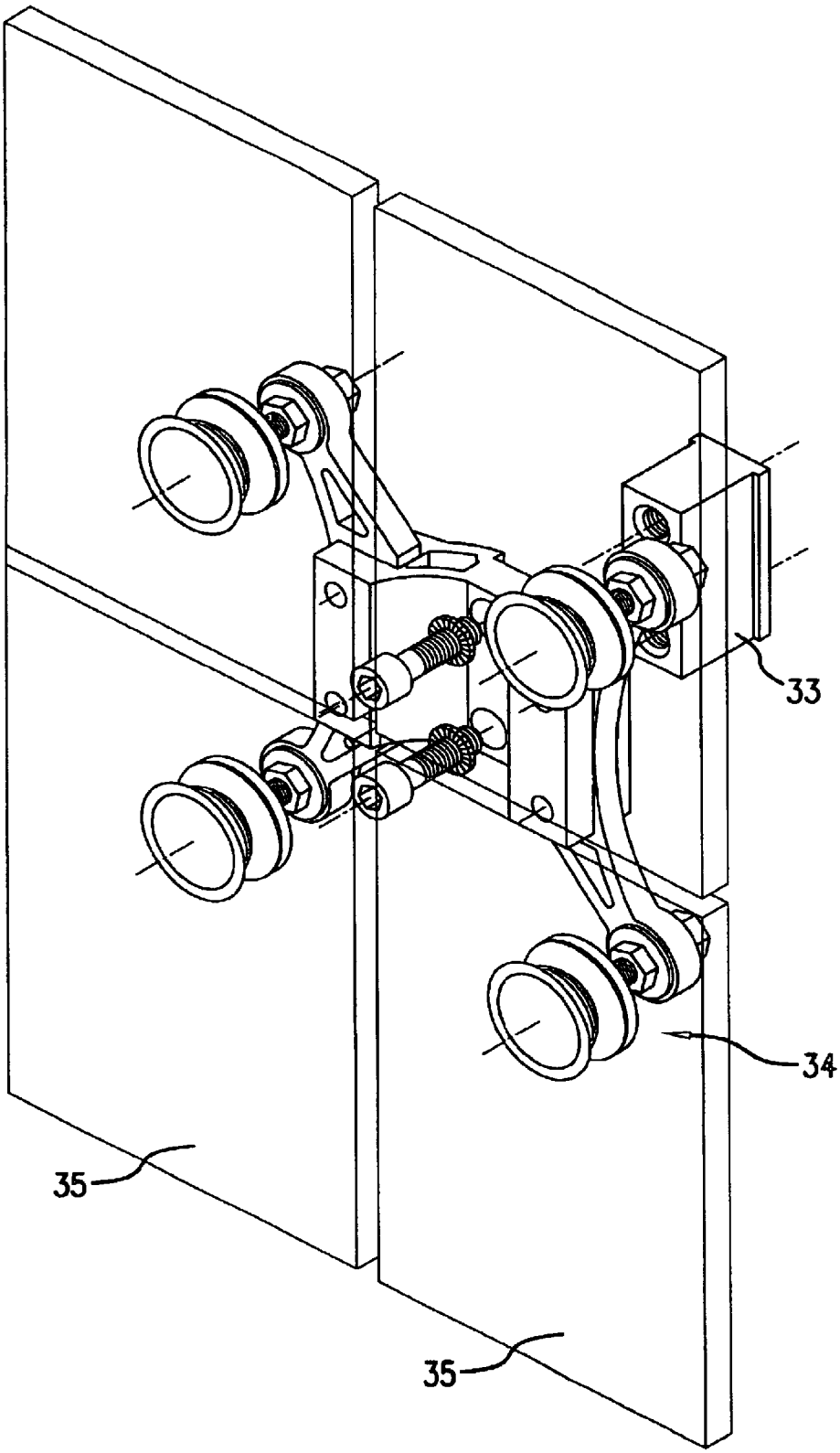
FIG. 11 is a perspective view of the connected plates of FIG. 10.

In practice, the arm 20 is a double arm which enables insertion of two fixed or articulated joints 34 for fixing and supporting plates 35 (FIG. 11).

Preferably, the eyelets 24, 25 are slots that extend parallel to the axis of symmetry 21; alternatively, at least one of the slots can be a circular opening.

Figure 17:
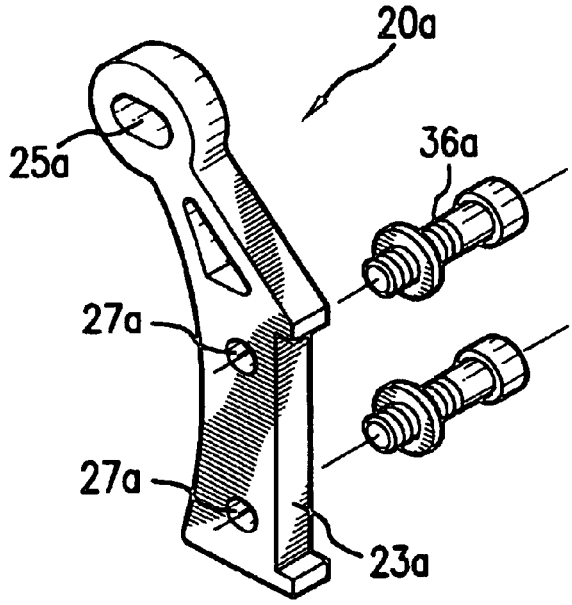
FIG. 17 is a perspective view of the extruded arm section illustrated in FIG. 15.

The second embodiment has arms 20*a* (FIGS. 15 and 17), wherein the crescent-shape of the arm 20 of the first embodiment is modified in that it has only one eyelet 24*a* and the shape of the half of a crescent. The single arm 20*a* will be used where the arm does not have to support more than one plate.

Figure 1:
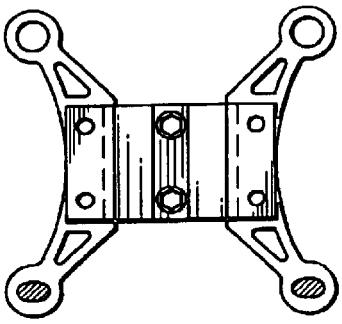
FIG. 1 is a schematic view of one possible configuration of the cross of the present invention.
Figure 5:
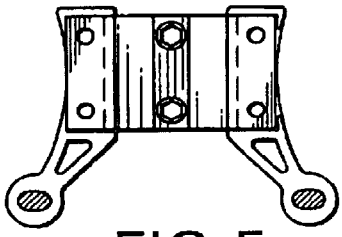
FIG. 5 is a schematic view of a fifth possible configuration of the cross of the present invention.
Figure 2:
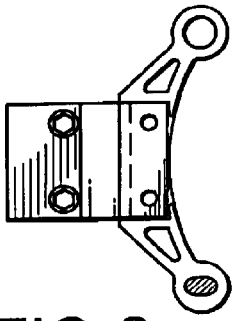
FIG. 2 is a schematic view of a second possible configuration of the cross of the present invention.
Figure 6:
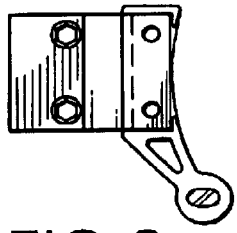
FIG. 6 is a schematic view of a sixth possible configuration of the cross of the present invention.
Figure 3:
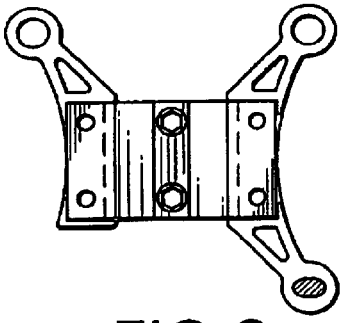
FIG. 3 is a schematic view of a third possible configuration of the cross of the present invention.
Figure 7:
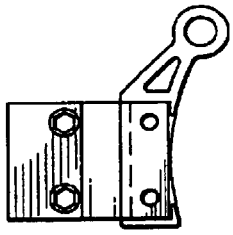
FIG. 7 is a schematic view of a seventh possible configuration of the cross of the present invention.
Figure 4:
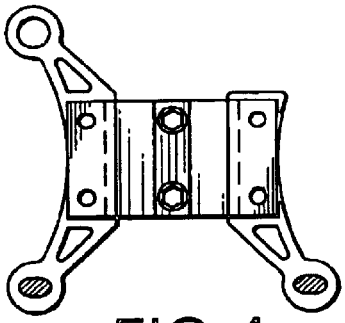
FIG. 4 is a schematic view of a fourth possible configuration of the cross of the present invention.
Figure 8:
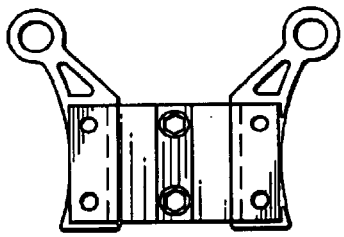
FIG. 8 is a schematic view of an eighth possible configuration of the cross of the present invention.
Figure 9:
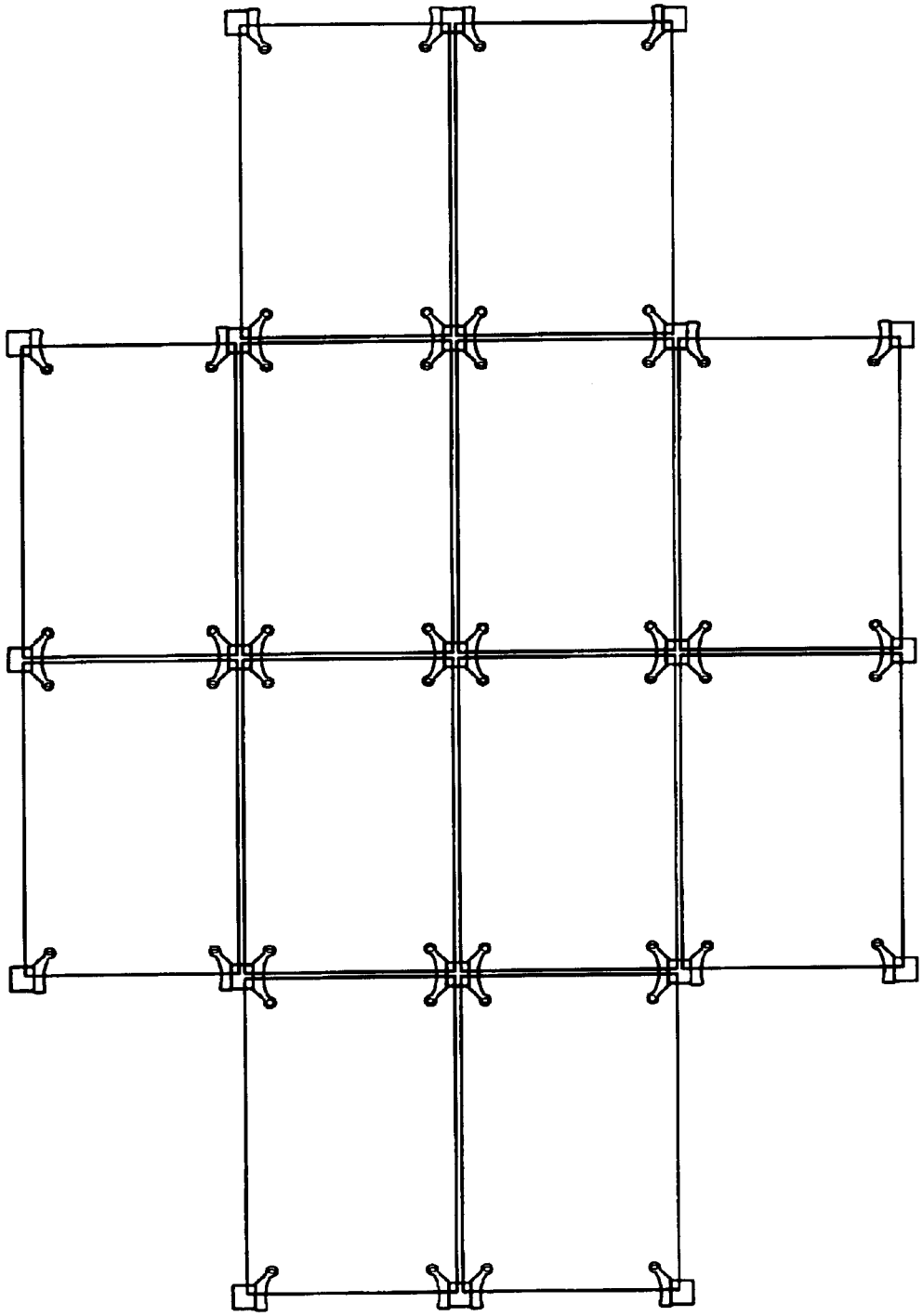
FIG. 9 is a schematic representation of a facade made using the crosses of the present invention.
Figure 10:
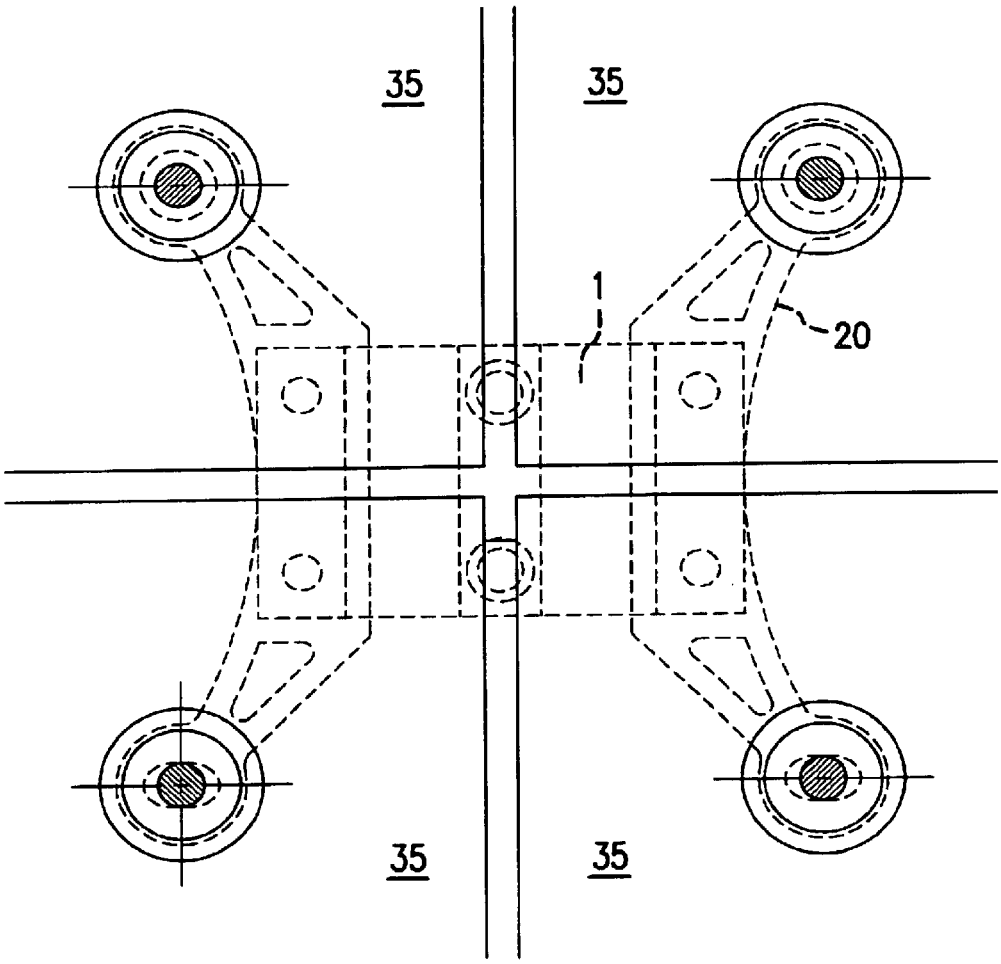
FIG. 10 is an enlarged view of connection of corners of plates in the facade of FIG. 9.

In fact, with as few as four metal bodies of rectilinear axis and constant cross-section (the central bodies 1 and 1*a* and the arms 20 and 20*a*), it is possible to put together a wide range of crosses, which in effect cover all the types necessary for making a suspended facade of the point-supported type, as shown in FIGS. 9 and 11.

In the embodiment illustrated herein, connecting screws 36 are provided between the arms 20 and the pairs of flanges 5, 6 and 7, 8 of the omega section (central body 1) of the first embodiment. Likewise, in the second embodiment, connecting screws 36*a* are provided between the arms 20*a* and flanges 7*a* and 8*a*. Of course, a person skilled in the art will be able to conceive other connecting members.

What is claimed is:

1. A connector with a rectilinear axis, with a constant cross section, and with a symmetrical profile with respect to an axis of symmetry, said connector having a generally omega shape and comprising:

an arched portion defining a generally convex top and a generally concave bottom, said arched portion having an axial groove formed in the convex top and one or more first through holes on the axis of symmetry; and a pair of flanges extending from each of two opposing sides of the arched portion, each of said pair of flanges defining therebetween a substantially rectangular groove, wherein one or more pairs of second through holes are formed in each of said pair of flanges, said constant cross-section being perpendicular to said first and second through holes.

2. The connector according to claim 1, in which the arched portion has a planar surface at the concave bottom of the arched portion.

3. The connector according to claim 1, in which closed cavities are symmetrically located in the arched portion on opposing sides of the axis of symmetry.

4. The connector according to claim 1, wherein a plurality of said first through holes are aligned on the axis of symmetry, each of said first through holes having a portion of a larger diameter at the concave bottom of the arched portion to receive the head of a screw.

5. The connector according to claim 1, in which one of the two second through holes of each pair of through holes in each pair of said flanges has a widened part for receiving, at least partially, the head of a screw, and the other of the two second through holes of each pair is threaded.

6. A connector including:

a body portion of constant cross-section and shaped as half an arch defining a generally convex top and a generally concave bottom, said body portion having a groove formed in the convex top and defining a first axis and one or more first through holes located on the first axis, said constant cross-section being perpendicular to said first through holes, and a pair of flanges having at least one pair of second through holes aligned on a second axis perpendicular to said first axis, said flanges extending from one side of said body portion and spaced apart to define a substantially rectangular groove therebetween.

7. The connector according to claim 6 wherein the first through holes are formed in the half arch on the first axis.

8. A connecting element with a rectilinear axis, with constant cross-section and with a symmetrical profile with respect to an axis of symmetry, and having a generally crescent shape with opposing, generally convex and concave edges, a rectangular groove formed in and extending across the convex edge and defining an axis, through holes aligned substantially parallel to the rectilinear axis, and an eyelet at each end of the crescent shape, wherein said rectangular groove enables a slot-in connection with a support for the connecting element and wherein said constant cross-section is perpendicular to said through holes.

9. The connecting element according to claim 8, wherein at least one of the eyelets is a slot oriented perpendicular to the axis of said rectangular groove.

10. A connecting element with a rectilinear axis and constant thickness, the connecting element having a shape generally in the form of half a crescent with opposing generally convex and concave edges, a rectangular groove formed in and extending across the convex edge, through holes aligned substantially parallel to the rectilinear axis and an eyelet at one end, wherein said rectangular groove enables a slot-in connection with a support for the connecting element.

11. A cross for connecting plates in a planar array comprising:

a connector with a rectilinear axis, with a constant cross-section, and with a symmetrical profile with respect to an axis of symmetry, said connector having a generally omega shape and including an arched portion defining a generally convex top and a generally concave bottom, an axial groove formed in the convex top of the arched portion, and one or more first through holes on the axis of symmetry; and a pair of flanges extending from each of two opposing sides of the arched portion, each of said pair of flanges defining therebetween a substantially rectangular groove, wherein one or more pairs of second through holes are formed in each of said pair of flanges and wherein said constant cross-section is perpendicular to said first and second through holes; and mechanically fixed within at least one of said rectangular grooves, a connecting element with a rectilinear axis, with constant cross-section, and with a symmetrical profile with respect to an axis of symmetry, the connecting element being generally crescent in shape and having third through holes aligned substantially parallel to the rectilinear axis and an eyelet at each end of the crescent shape, wherein the constant cross-section of said connecting element is perpendicular to said third through holes.

12. A cross according to claim 11, wherein the crescent shape of the connecting element is defined by opposing generally convex and generally concave opposing edges, wherein a groove is formed in and extends across the convex edge, and wherein said groove provides a slot-in connection with a pair of said flanges.

13. A cross according to claim 11 wherein at least one of said eyelets of said connecting element is a slot that extends perpendicular to the axial groove.

14. A cross according to claim 11 wherein said generally concave bottom includes a planar surface portion.

15. A cross according to claim 11 in which closed cavities are symmetrically located in the arched portion on opposing sides of the axis of symmetry.

16. A cross according to claim 11, wherein a plurality of said first through holes are aligned on the axis of symmetry, each of said first through holes having a portion of a larger diameter at the concave bottom of the arched portion to receive the head of a screw.

17. A cross according to claim 11, in which one of the two second through holes of each pair of second through holes in said flanges has a widened part for receiving, at least partially, the head of a screw, and in which the other of the two second through holes of each pair of second through holes is threaded.

18. A cross for connecting plates in a planar array, comprising:

a connector having a constant cross-section and including a body portion shaped as half an arch defining a generally convex top and a generally concave bottom, a groove formed in the convex top and defining a first axis, one or more first through holes on the first axis, and a pair of flanges having at least one pair of second through holes aligned on a second axis perpendicular to said first axis, said pair of flanges extending from one side of said body portion and spaced apart to define a substantially rectangular groove therebetween, said constant cross-section being perpendicular to said first and second through holes; and mechanically fixed within said rectangular groove, a connecting element with a rectilinear axis and constant cross-section and with a symmetrical profile with respect to an axis of symmetry, the connecting element being generally crescent in shape and having third through holes aligned substantially parallel to the rectilinear axis and an eyelet at each end of the crescent shape, wherein the constant cross-section of said connecting element is perpendicular to said third through holes.

19. A cross according to claim 18, wherein the crescent shape of the connecting element is defined by generally convex and generally concave opposing edges, wherein a groove is formed in and extends across the convex edge, and wherein said groove provides a slot-in connection with a pair of said flanges.

20. A cross according to claim 18, wherein at least one of said eyelets of said connecting element is a slot that extends perpendicular to the first axis.

21. A cross according to claim 18 wherein said generally concave bottom includes a planar surface portion.

22. A cross according to claim 18 in which a closed cavity is formed in the body portion.

23. A cross according to claim 18, wherein a plurality of said first through holes are aligned on the first axis, each of said first through holes having a portion of a larger diameter at the concave bottom of the half arch to receive the head of a screw.

24. A connector according to claim 18, in which one of the two second through holes of each pair of second through holes in said pair of flanges has a widened part for receiving, at least partially, the head of a screw, and in which the other of the two second through holes of each pair of second through holes is threaded.

25. A cross for connecting plates in a planar array, comprising:

a connector with a rectilinear axis, with a constant cross-section, and with a symmetrical profile with respect to an axis of symmetry, said connector having a generally omega shape and including an arched portion defining a generally convex top and a generally concave bottom, an axial groove formed in the convex top of the arched portion, and one or more first through holes on the axis of symmetry; and a pair of flanges extending from each of two opposing sides of the arched portion, each of said pair of flanges defining therebetween a substantially rectangular groove, wherein one or more pairs of second through holes are formed in each of said pair of flanges, and wherein said constant cross-section is perpendicular to said first and second through holes; and mechanically fixed within at least one of said rectangular grooves, a connecting element with a rectilinear axis and constant cross-section, the connecting element having a shape generally in the form of half a crescent, the connecting element having a rectangular groove formed in and extending across the convex edge, third through holes aligned substantially parallel to the rectilinear axis and an eyelet at one end, wherein the constant cross-section of said connecting element is perpendicular to said third through holes.

26. A cross according to claim 25, wherein the half crescent shape of the connecting element is defined by generally convex and generally concave opposing edges, wherein a groove is formed in and extends across the convex edge, and wherein said groove provides a slot-in connection with a pair of said flanges.

27. A cross according to claim 25 wherein said eyelet of said connecting element is a slot that extends perpendicular to the axial groove.

28. A cross according to claim 25 wherein said generally concave bottom includes a planar surface portion.

29. A cross according to claim 25 in which closed cavities are symmetrically located in the arched portion on opposing sides of the axis of symmetry.

30. A cross according to claim 25, wherein a plurality of said first through holes are aligned on the axis of symmetry, each of said first through holes having a portion of a larger diameter at the concave bottom of the arched portion to receive the head of a screw.

31. A cross according to claim 25, in which one of the two second through holes of each pair of second through holes in each pair of said flanges has a widened part for receiving, at least partially, the head of a screw, and the other of the two second through holes of each pair is threaded.

32. A cross for connecting plates in a planar array, comprising:

a connector including a body portion shaped as half an arch defining a generally convex top and a generally concave bottom, a groove formed in the convex top and defining a first axis, one or more first through holes on the first axis, and a pair of flanges having at least one pair of second through holes aligned on a second axis perpendicular to said first axis, said flanges extending from one side of said body portion and spaced apart to define a substantially rectangular groove therebetween; and mechanically fixed within said rectangular groove, a connecting element with a rectilinear axis and constant cross-section, the connecting element having a shape generally in the form of half a crescent, third through holes aligned substantially parallel to the rectilinear axis, and an eyelet at one end and wherein said constant cross-section is perpendicular to said third through hole.

33. A cross according to claim 32, wherein the half crescent shape of the connecting element is defined by generally convex and generally concave opposing edges, wherein a groove is formed in and extends across the convex edge, and wherein said groove provides a slot-in connection with a pair of said flanges.

34. A cross according to claim 32, wherein said eyelet of said connecting element is a slot that extends perpendicular to the first axis.

35. A cross according to claim 32 wherein said generally concave bottom includes a planar surface portion.

36. A cross according to claim 32 in which a closed cavity is formed in the body portion.

37. A cross according to claim 32, wherein a plurality of said first through holes are aligned on the first axis, each of said first through holes having a portion of a larger diameter at the concave bottom of the arched portion to receive the head of a screw.

38. A connector according to claim 32, in which one of the two second through holes in said pair of flanges has a widened part for receiving, at least partially, the head of a screw, and the other of the two second through holes is threaded.

* * * * *